United States Patent [19]

Fuchs et al.

[11] Patent Number: 4,617,673

[45] Date of Patent: Oct. 14, 1986

[54] ELECTRIC ARC FURNACE HAVING A SPACE PROVIDED ON ONE SIDE OF THE FURNACE VESSEL FOR ACCOMMODATING CHARGING MATERIAL

[75] Inventors: Gerhard Fuchs, Kehl-Bodersweier; Joachim Ehle, Lautenbach, both of Fed. Rep. of Germany

[73] Assignee: Fuchs Systemtechnik GmbH, Fed. Rep. of Germany

[21] Appl. No.: 738,965

[22] Filed: May 29, 1985

[30] Foreign Application Priority Data

Jun. 8, 1984 [DE] Fed. Rep. of Germany ..... 3421485

[51] Int. Cl.[4] ..... H05B 7/10; H05B 7/00

[52] U.S. Cl. ..... 373/80; 373/60; 373/94; 373/99

[58] Field of Search ..... 373/85, 86, 79, 80, 373/81, 87, 60, 73, 94, 98, 99, 105

[56] References Cited

U.S. PATENT DOCUMENTS 4,071,687 1/1978 Nakagawa et al. ..... 373/86

*Primary Examiner*—Roy N. Envall, Jr.

[57] ABSTRACT

An arc furnace having a space for accommodating charging material, said space being disposed on one side of the furnace vessel and communicating with the interior of the furnace vessel and being disposed at least partly in the region of radiation of the arc of at least one arc electrode. The arc electrode is movable towards and away from the charging material accommodating space, and thereby permits better utilization of the radiant heat generated by the arc.

17 Claims, 7 Drawing Figures

Figure 1:
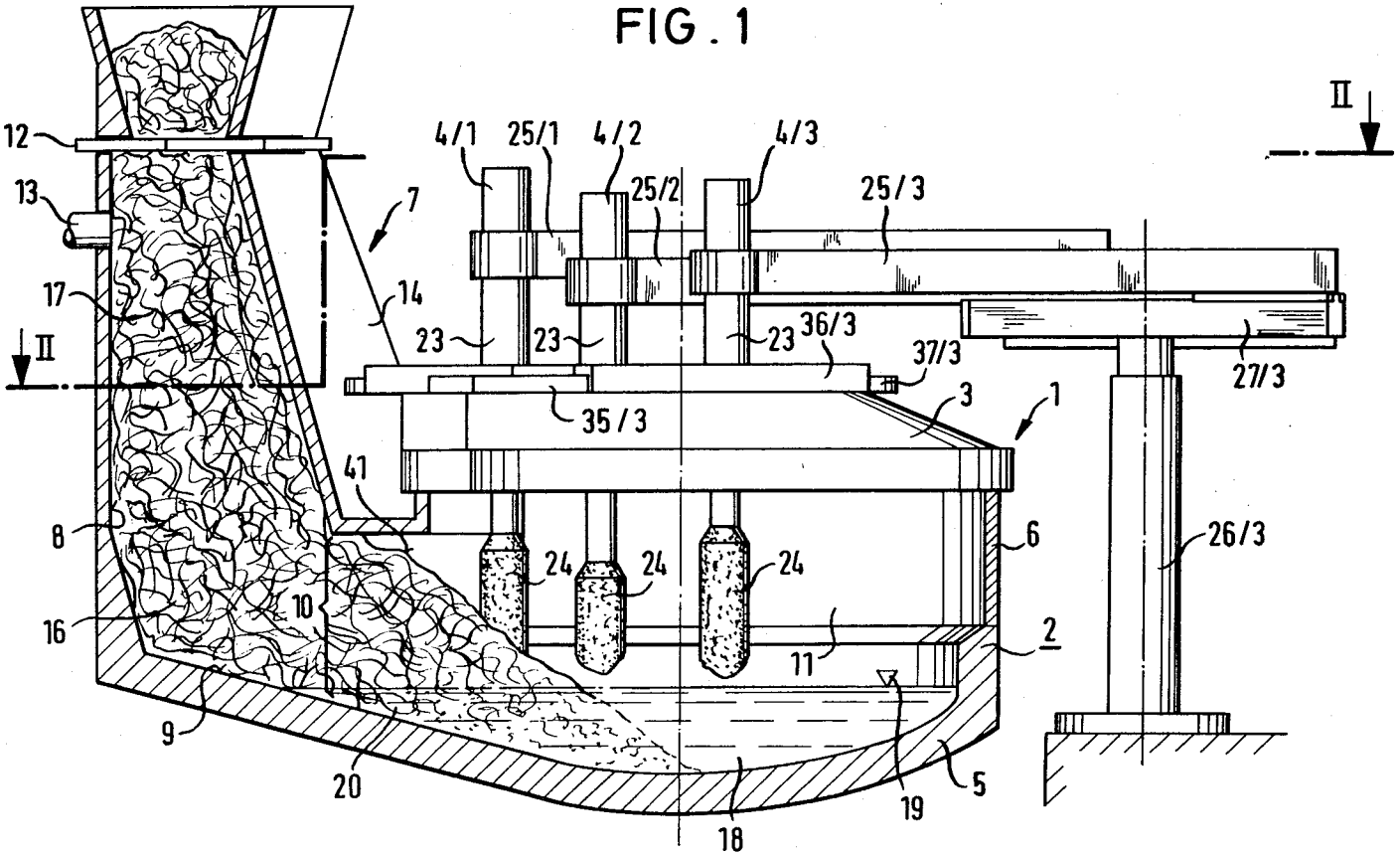

ELECTRIC ARC FURNACE HAVING A SPACE PROVIDED ON ONE SIDE OF THE FURNACE VESSEL FOR ACCOMMODATING CHARGING MATERIAL

DESCRIPTION

The invention relates to an electric arc furnace having at least one space for accommodating charging material, which is provided on one side of the furnace vessel.

In the arc furnace of that kind which is disclosed in EP-Al No. 56,773, the arc furnace has a lateral bulge portion, the sole of which is at a higher level than the sole of the furnace hearth. The charging material is introduced into the outwardly bulged portion of the furnace and is stored in a heap on the elevated sole. The hot furnace gases are passed through the upper part of the heap of charging material, while in addition that heap of charging material is exposed to and heated by the radiant heat from the arc furnace. The charging material, which has been preheated, is conveyed from the lowermost section of the heap of material into the furnace hearth by a pusher member. The sole of the lateral outwardly bulged portion of the furnace is arranged to have a fall towards the furnace hearth.

US Pat. Spec. No. 3,441,651 discloses an electric arc furnace having a shaft-like charging material preheater which is disposed at one side of the furnace vessel and the interior of which communicates with the interior of the furnace vessel through a connecting zone which is provided approximately at the mid-height position of the furnace vessel. The connecting zone serves on the one hand to conduct the hot furnace gases which are produced in the smelting process into a column of charging material which is formed in the charging material preheater, and to pass those gases through the downwardly moving charging material in counter-flow relationship therewith, thereby to preheat such material, while on the other hand the connecting zone also serves as a discharge opening for the heated charging material in the floor region of the charging material preheater. The respective lowermost portion of the column of charging material, which has been preheated, can be conveyed by means of a hydraulically operable pusher member through the connecting zone into the furnace hearth, that is to say, the charge material is fed to the smelting vessel by a thrust motion. A charging means which is disposed at the top of the preheater permits a continuous feed of charging material into the preheater, while a gas outlet which is disposed in the vicinity thereof provides for removal of the furnace gases which are cooled down by being in heat-exchange relationship with the charging material within the column thereof.

In an electric arc furnace according to the present invention the object is to increase the possible conveyance of heat into the charging material, thereby to reduce the time taken for heating up the charging material. The invention seeks to provide for better utilisation of the radiant heat as well as the hot furnace gases which are produced, when heating up the charging material, thereby to improve the level of thermal efficiency. The invention also seeks to reduce the thermal loading of the furnace walls, as well as permitting a continuous flow of material from the charging material accommodating space or chamber into the furnace hearth, and thus also permitting more uniform operating conditions. The invention further seeks to provide for a reduction in fluctuations in temperature and fluctuations in the chemical composition of the smelting bath.

In the construction according to the invention, the electrodes can be brought into the direct vicinity of the charging material accommodating space or chamber which is provided on one side of the furnace vessel, by a change in respect of position either of the arc electrodes or the furnace vessel together with the accommodating space or chamber, so that the radiant heat which is generated by the arcs can act to an increased degree on the charging material and at the same time the radiation loading on the free wall regions of the arc furnace is reduced. The hot gases which are produced in particular when adding coal and other batch materials in the region of the arcs are conducted directly into the charging material so that the sensible heat thereof can be utilised to the optimum degree. Those two effects make it possible substantially to enhance the level of thermal efficiency.

By virtue of the direct action of the arcs on the lower region of the heap or column of charging material, the charging material may be put into a pasty or plastic and fluid condition so as to permit a continuous flow from the charging material accommodating space or chamber into the furnace hearth.

If in addition the construction includes nozzles and/or burners which are directed on to the lower region of the charging material accommodating space, that area may be additionally heated, or oxygen, coal or other additives may be introduced for the purposes of temperature control and for controlling the composition of the smelting bath.

Preferably, the floor of the charging material accommodating space is arranged at such a depth that, when a liquid sump pool is formed in the furnace hearth, the pool extends into the accommodating space and permits direct material exchange and conductive heat exchange in the lowermost region of the heaped charging material. That provides for an additional flow of heat for the lowermost region of the column of charging material which is standing in the liquid sump pool. An intensive material and heat exchange effect takes place in that region, caused by the movement of the bath which always occurs in the furnce hearth. In that way, the molten material which is overheated in the region of the arcs supplies heat to that region whereby the material which has already been preheated is caused to melt in that region. The liquefied material flows continuously out of the charging material accommodating space into the liquid molten bath of the furnace hearth so that there the operating conditions can be kept substantially constant. In addition, the region of the solid-liquid transition is the site of chemical-metallurgical conversion phenomena such as the formation of slag, carburisation, etc, which can be promoted by the controlled feed of oxygen, coal or additive materials. In that way, not only is it possible for the thermal conditions in the furnace hearth to be kept constant and adjusted to an optimum operating point, but in addition it is possible to prevent major fluctuations in the composition of the molten material and to control the composition thereof.

When a sufficient pool has been formed in the furnace hearth, but at the latest when the level of the molten material has reached the tapping-off level, the electrodes are returned to the middle of the furnace by a change in position either of the arc electrodes or the furnace vessel together with the charging material accommodating space, and in that position the bath is heated up to the necessary tapping-off temperature. Due to the mobility of the electrodes or the furnace, it is thus possible in the course of the smelting process to alter the position of the heat source within the furnace in such a fashion that both the smelting process and also metallurgical procedures can take place in the optimum fashion within the furnace.

Figure 2:
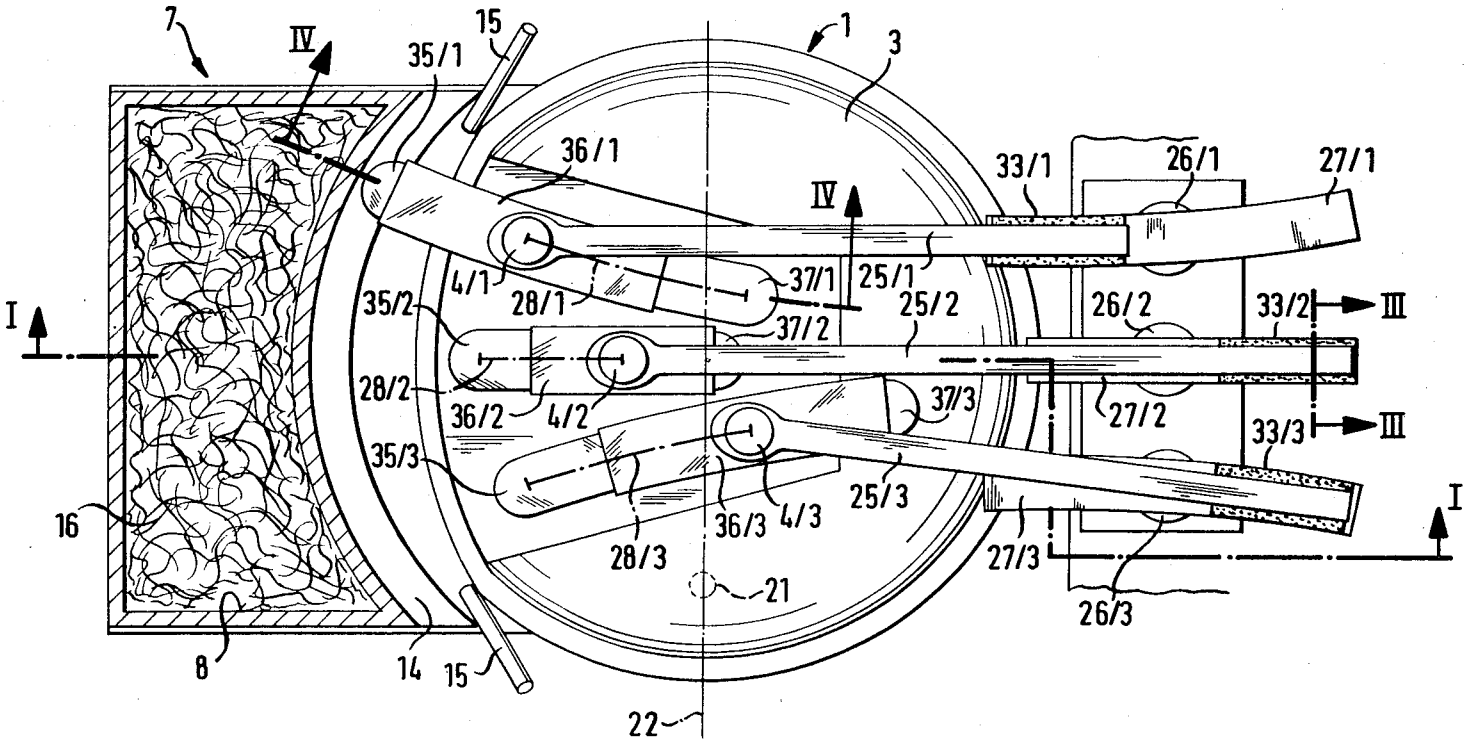
Figure 4:
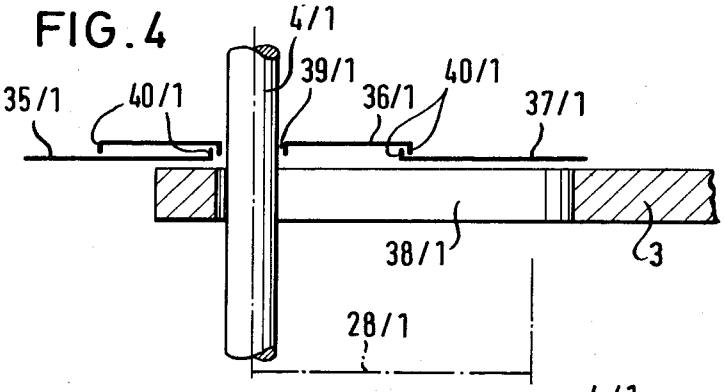
Figure 5:
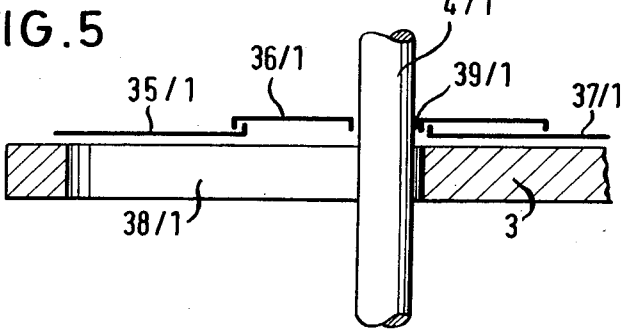
Figure 3:
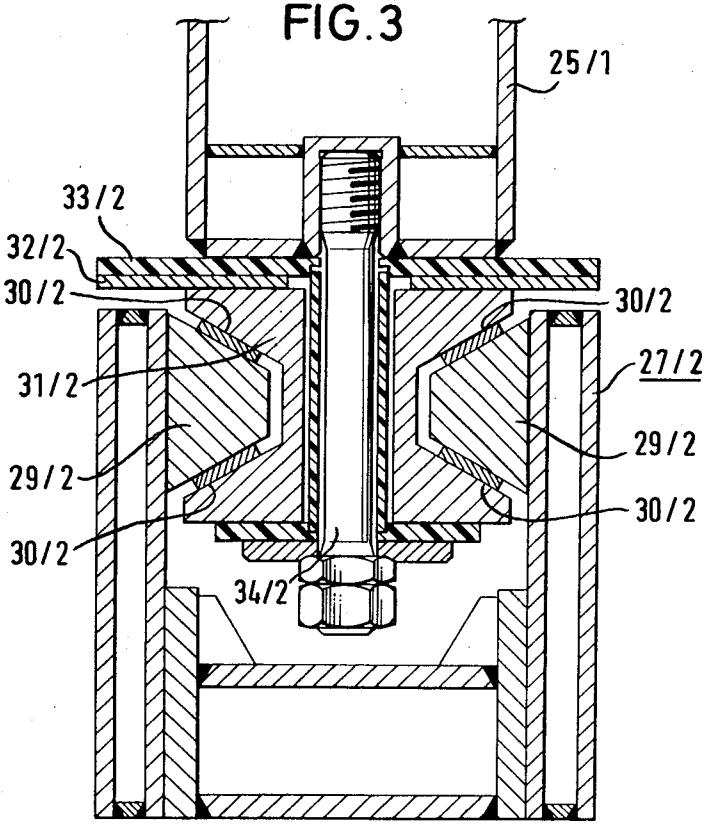
Figure 6:
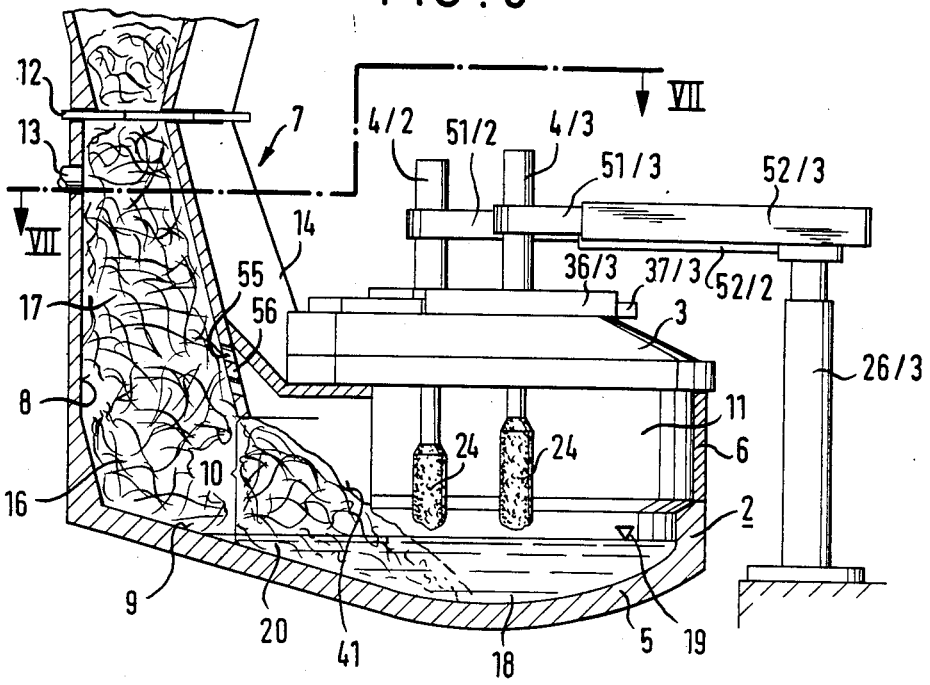
Figure 7:
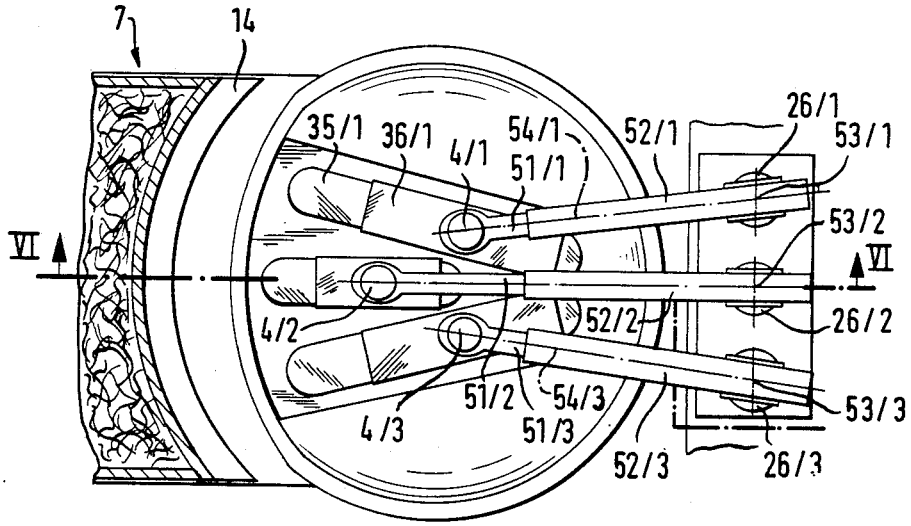

The invention will be described in greater detail by means of embodiments with reference to seven Figures of drawings in which:

FIG. 1 shows a diagrammatic view in vertical section through an arc furnace with a charging material accommodating space or chamber disposed on one side of the furnace vessel, FIG. 2 shows a partly sectional plan view of the construction shown in FIG. 1, FIG. 3 shows a view on an enlarged scale in section taken along line III—III in FIG. 2, FIG. 4 shows a view in section taken along line IV—IV in FIG. 2, FIG. 5 shows a sectional view corresponding to that shown in FIG. 4, with the electrode in another position, and FIGS. 6 and 7 are views corresponding to those shown in FIGS. 1 and 2, of a second embodiment of the invention.

Referring to FIGS. 1 and 2, the furnace assembly shown therein in vertical section and in plan respectively includes an arc furnace 1 comprising a furnace vessel 2 and a removable cover 3 through which are passed three electrodes 4/1, 4/2, and 4/3. The furnace vessel 2 is formed by a furnace hearth 5, comprising a refractory lining, and preferably fluid-cooled wall elements 6. Disposed on one side of the furnace vessel which, in the present case, as shown in FIG. 2, is round in cross-section, is a shaft-like charging material preheater 7 having a space (chamber) 8 therewithin, for accommodating charging material, which, in a region adjoining its floor 9, communicates with the chamber 11 inside the furnace vessel 2, by way of a connecting zone 10. The charging material preheater is provided in its upper region with a gas-tight charging arrangement 12, for example a double bell closure arrangement of known design, as well as a gas outlet to which a suction removal means (not shown) is connected.

As shown in FIG. 2, the preheater 7 extends approximately over a quarter of the periphery of the furnace vessel 2, while the shaft wall 14 of the preheater, which is towards the furnace vessel, matches the outside contour of the furnace vessel. It will be seen from FIG. 1 that the cross-section of the space 8 within the preheater 7 is of an enlarging configuratio in a downward direction. That is intended to permit the charging material to move unimpededly downwardly in the charging material preheater 7. Burners 15 or nozzles for injecting gases, such as oxygen, or solids, such as coal or additive materials, discharge into the connecting zone 10.

The charge material 16 which is charged into the charging material preheater 7 may comprise metal scrap, in particular steel scrap and other iron-bearing materials such as crude or pig iron in lump form, sponge iron and additive and flux materials. The material introduced into the preheater 7 forms therein a gas-pervious column of material, referred to as the charging material column 17. The molten metal bath (sump pool) which is formed in the arc furnace 1 is denoted by reference numeral 18 while the level of molten material is denoted by reference numeral 19.

The floor 9 of the preheater 7 which is preferably arranged to have a fall towards the furnace hearth 5 is arranged at such a depth that, over a substantial part of the smelting process, a liquid sump pool 18 which is formed in the furnace hearth extends into the lowermost region 20 of the column 17 and there permits direct material exchange and conductive heat exchange to take place. Provided in the floor of the furnace hearth 5 is an eccentric bottom tapping hole 21 which is shown in dotted line in FIG. 2. In the present case, the furnace vessel 2 is designed to be tilted. The tilting plane, that is to say, the plane in which the tilting movement occurs, is denoted by reference numeral 22. The preheater 7 is disposed in a direction which is transverse with respect to the tilting plane of the furnace vessel.

Each of the electrodes 4/1, through 4/3 inclues a liquid-cooled metallic upper portion 23 and a lower portion 24 which forms the electrode tip and which comprises a consumable material such as graphite. The lower portion 24 is releasably secured to the upper portion 23. Each electrode 4/1, 4/2 and 4/3 is gripped with its upper portion 23 in a respective electrode carrier arm 25/1, 25/2 and 25/3; each electrode carrier arm can be raised and lowered by means of an electrode lift mechanism 26/1, 26/2 and 26/3 respectively. The electrode lift mechanism 26/1 through 26/3 are arranged beside the furnace vessel 2, on the side which is in opposite relationship to the charging material accommodating space or chamber, that is to say, the shaft-like charging material preheater 7.

In the case of the embodiment illustrated in FIGS. 1 and 2, each of the electrode carrier arms 25/1 through 25/3 is connected to the respectively associated lifting mechanism 26/1, 26/2 and 26/3 by way of a horizontal guide means 27/1, 27/2 and 27/3 respectively, and can be reciprocated along the guide means by a drive means which is not shown in the drawing but which is operative in two directions. The guide means 27/1 and 27/3 of the two outer electrode carrier arms 25/1 and 25/3 are each curved outwardly so that, upon the reciprocating movement of the electrode carrier arms 25/1 and 25/3, those arms are pivotable through a restricted angle in a horizontal plane. The paths of movement of the centre lines of the electrodes 4/1 through 4/3, during the forward and backward movement of the electrode carrier arms along the guide means 27/1 through 27/3 are shown in dash-dotted lines in FIG. 2 and are denoted by references 28/1 through 28/3. It will be seen that the paths of movement 28/1 and 28/3 are also curved outwardly, due to the curved guide means 27/1 and 27/3. The ends of the paths of movement are marked by transverse bars which thus show the limit positions in respect of the centre lines of the electrodes. In the left-hand limit position shown in FIG. 2, the electrodes 4/1, 4/2 and 4/3 are each disposed at approximately the same spacing from the charging material accommodating space or chamber 8.

The horizontal guide means 27/1 through 27/3 for the electrode carrier arms 25/1 through 25/3 may be of the configuration shown in FIG. 3. FIG. 3 shows a view in section taken along line III—III in FIG. 1, on an enlarged scale. As shown in FIG. 3, the guide means 27/2 includes two slide bars or rails 29/2 which are disposed in mutually opposite relationship and which are of trapezoidal cross-section, each having an upper and a lower slide track 30/2, the slide tracks being formed by a coating or applied portion of sliding material. Bearing against the slide tracks 30/2 are the sliding surfaces of a carriage 31/2 which is thereby fixed in its position while being displaceable along the rails 29/2. The carriage 31/2 carries the carrier arm 25/2 which is fixed on the carriage 31/2 with the interposition of a cover plate 32/2 and an insulating plate 33/2, by means of a screw bolt 34/2. The insulating plate 33/2 which is of the same length as the carriage 31/2 is also shown in part in FIG. 2. It will be ssen from that view that, for reasons of stability, the carriage 31/2 extends over approximately one third to one half of the length of the guide means 27/2.

The guide means 27/1 and 27/3 for the two outer carrier arms 25/1 and 25/3 are of a similar construction. As can be seen from FIG. 2 however, they are curved, that is to say, when considered in plan view, the respective rails 29/1 and 29/3 are of a correspondingly curved configuration.

In order to permit the paths of movement 28/1 through 28/3 of the electrodes 4/1 through 4/3 when the cover is in the closed condition, the cover is provided, for each electrode, with a slot-like means for passing the electrode therethrough, said slot-like means being adapted to the path of movement of the respective electrode. The slot-like electrode-passing means are covered over by cover plates 35/1, 36/1, 37/1 through 35/3, 36/3, 37/3 which are displaceable along the horizontal path of movement and one of which has a through opening which is adapted to the electrode cross-section. The cover plates 35/1 through 37/3 close off the slot-like electrode-passing means in the cover in any position of the electrode along the path of movement 28/1, 28/2 and 28/3 respectively thereof.

FIGS. 4 and 5 show the position of the cover plates 35/1 through 37/1 of the electrode 4/1 in the two limit positions thereof, in diagrammatic form. A similar situation applies in regard to the cover plates of the other two electrodes 4/2 and 4/3.

The slot-like electrode-passing means in the cover 3, which can be seen in the views shown in FIGS. 4 and 5, is denoted by reference numeral 38/1, while the through opening in the cover plate 36/1, being adapted to the electrode cross-section, is denoted by reference numeral 39/1.

As can be seen from FIGS. 4 and 5, the ends of the middle cover plate 36/1 each engage over one end of the respective outer cover plates 35/1 and 37/1 respectively. Provided at the overlapping ends of the above-indicated cover plates are entrainment members 40/1 which, in the event of displacement of the electrode 4/1 along the path of movement 28/1, and the resulting movement of the middle cover plate 36/1, each entrain the outer plates by a respective distance and thus ensure that the electrode through-passing means 38/1 is completely closed off, with the electrode 4/1 in any position.

The smelting process using the furnace assembly described with reference to FIGS. 1 through 5 will now be described.

The solid charge material 16 in lump form is charged into the space or chamber 8 of the charging material preheater 7 by the charging arrangement 12 until the material has formed an adequate column 17 of material therein. In the region of the connecting zone 10, the solid charge material passes partly into the furnace hearth, because of the natural angle of slope adopted by the bulk charging material, as indicated at 41.

The electrodes 4/1 through 4/3 are now moved towards the preheater 7 and the smelting process is commenced by lowering the electrodes in the region of the heap of charging material. The liquid metal pool which is then formed collects in the furnace hearth and causes an intensive material and heat exchange effect to occur due to the movement of the bath in the lowermost region of the column of charging material 17. That region may also be the site of desired metallurgical conversion phenomena which are controlled by the control feed of oxygen, coal or additive or fluxing materials in the region indicated by the burners 15, or by virtue of additive materials which are mixed with the charging material. Heat may additionally be applied by means of the burners 15. At the same time as the smelting process takes place, the material 16 in the column 17 moves downwardly so that it is also caused to undergo melting in the lowermost region of the column 17. In order to promote the above-indicated downward movement, the cross-section of the chamber 8 of the preheater 7 is of an enlarging configuration, in a downward direction.

As long as the electrodes 4/1 through 4/3 are in the position adjacent the shaft-type furnace or preheater 7, that is to say, in the view shown in FIG. 2, in the vicinity of or at the left-hand limit position of the paths of movement 28/1 through 28/3, the radiant energy of the arcs is applied to an increased degree to the lower region of the column 17 of material, and thus optimum use is made thereof for causing the material to melt. The same also applies in regard to the furnace waste gases which, by virtue of their being sucked away by way of the gas outlet 13, pass directly out of the regions of the arcs into the column 17 of material.

When a sufficient amount of charge material has been caused to melt, the electrodes are returned to the right-hand limit position of the paths of movement 28/1 through 28/3, as shown in FIG. 2, and the bath is brought up to the necessary tapping temperature. The tapping operation is carried out by way of the tapping arrangement 21 which is disposed in the floor of the arc furnace. In that operation, a part of the pool of metal in the furnace vessel is preferably retained therein for the next smelting operation.

Due to the horizontal displaceability of the electrodes, the arcs can always be put into the respective position which is advantageous for a given situation, in regard to the smelting process, heating of the liquid molten bath and the loading applied to the furnace walls. The electrodes 4/1 through 4/3 may adopt any intermediate positions along their paths of movement 28/1 through 28/3. In that way it is also possible, during the smelting process, for the arcs to be caused to burn only on a liquid pool which is already in existence, directly adjacent to the material which is still in a solid state, thereby making it possible to achieve more uniform operating conditions. As the important consideration in each case is only the relative position of the electrodes within the furnace vessel, it is also possible for the furnace vessel 2 to be moved, together with the charging material accommodating space 8, instead of moving the electrodes. Instead of the provision of the slot-like electrode-passing means 38/1 in the cover 3, it is also possible for the cover 3 to have a round electode-passing means for each electrode, at the two limit positions in respect of the relative movement of the cover 3 and the electrodes. In that case, before horizontal movement of the electrodes or the furnace vessel is effected, the electrodes must be lifted to a position above the upper edge of the cover by operation of the electrode lift mechanism 26/1 through 26/3.

In the second embodiment illustrated in FIGS. 6 and 7, each of the electrodes 4/1, 4/2 and 4/3 is gripped in a telescopically extensible electrode carrier arm 51/1, 51/2 and 51/3 respectively. The guide means 52/1, 52/2 and 52/3 for the electrode carrier arms can be raised and lowered by electrode lift mechanisms 26/1, 26/2 and 26/3 respectively, and are also rotatable through a restricted angle about vertical axes as indicated at 53/1, 53/2 and 53/3 respectively. The guide means 52/1 through 52/3 are thus respecitvely connected to the associated electrode lift mechanism 26/1 through 26/3 by way of a connection which is provided with a drive means and which is rotatable within a limited angle.

As in the case of the first embodiment, in the second embodiment as shown in FIGS. 6 and 7 the arc electrodes 4/1 through 4/3 can be moved from a configuration which is triangular in plan view, in the middle of the furnace vessel, as can be seen from FIG. 7, into an arcuate configuration adjacent to the charging material accommodating space or chamber, and back again. In addition, each of the two outer carrier arms 51/1 and 51/3 is capable of limited rotational movement about its longitudinal axis 54/1 and 54/3 respectively, although that possiblity is not shown in the drawing. In that way, the outer electrodes 4/1 and 4/3 may be inclined at a slight angle so that, in addition to the change in spacing between the tips of the electrodes by virtue of the predetermined paths of movement of the electrodes, the spacing between the electrode tips can also be altered by setting the electrodes in an inclined position. As the electrodes in the above-described furnace assemblies are no longer endangered by scrap material collapsing or caving in when the electrodes burn into a scrap charge in the furnace, the electrodes which are referred to as permanent electrodes are particularly suitable for this purpose, such electrodes comprising a fluid-cooled metal upper portion and a lower portion which forms the electrode tip, comprising a consumable material, which is releasably secured to the upper portion.

In the second embodiment, as shown in FIG. 6, the connecting zone 10 is of an enlarging configuration inclinedly upwardly from the interior 11 of the furnace vessel 2 to the chamber 8 of the charging material preheater 7, and a partitioning wall 56 which is provided with gas through-flow openings 55 is disposed in the enlarged region of the connecting zone 10. In that way, the hot furnace gases can be conducted into the column 17 of charging material, over a larger cross-sectional area thereof.

We claim:

1. An electric arc furnace comprising a furnace vessel (2), means defining a space (8) for accommodating charging material provided on one side of said furnace vessel and connected to the interior (11) of said furnace vessel, a cover (3) for closing said furnace vessel, electrode-passing means (38/1) located in said cover, at least one arc electrode (4/1, 4/2, 4/3) having one end thereof able to protrude via said electrode-passing means into the interior (11) of said furnace vessel, an electrode carrier arm (25/1; 25/2, 25/3; 51/1, 51/2, 51/3) having holding means, the other end of said arc electrode being clamped into said holding means, said space (8) being disposed at least partially in the area of radiation of the arc of said at least one arc electrode, and electrode left mechanism (26/1, 26/2, 26/3), said electrode carrier arm being connected to said electrode lift mechanism, characterized in that said electrode carrier arm is connected to said electrode lift mechanism by way of a horizontal guide means (27/1, 27/2, 27/3; 52/1, 52/2, 52/3) and is reciprocable along the guide means by a drive means which is operative in two directions, whereby the arc electrode and the furnace vessel are displaceable relative to each other in such a way that the arc electrode can be put into a central position in the furnace vessel or a position adjacent the charging material accommodating space (8), and said electrode-passing means comprises means for passing said arc electrode therethrough provided in the central region of the cover and means for passing said arc electrode therethrough provided at a location in the cover which is adjacent to the charging material accommodating space.

2. A furnace according to claim 1 characterized in that there are provided three arc electrodes (4/1, 4/2, 4/3), and said guide means (27/1, 27/2, 27/3; 52/1, 52/2, 52/3) are constructed such that said arc electrodes can be put into an arrangement which is triangular in plan view in the centre of the furnace vessel (2) or an arrangement which is linear or arcuate in plan view, adjacent to the charging material accommodating space (8).

3. A furnace according to claim 2 characterized in that the outer electrode carrier arms (25/1, 25/3; 51/1, 51/3) are pivotable through a restricted angle in a horizontal plane.

4. A furnace according to claim 1 characterised in that the electrode carrier arm (51/1, 51/2, 51/3) is telescopically extensible.

5. A furnace according to one of claims 1 characterised in that a floor (9) of the charging material accommodating space (8) is disposed at such a depth that, when a liquid sump pool (18) is formed in the furnace hearth, said liquid sump pool extends into said charging material accommodating space and permits direct material exchange and conductive heat exchange, in the lowermost zone of a column (17) of charging material.

6. A furnace according to one of claims 1 to 5 characterised in that the floor (9) of the charging material accommodating space (8) has a fall towards the furnace hearth (5).

7. A furnace according to claim 1 characterised in that the cross-section of the space (8) for accommodating the charging material (16) increases in a downward direction.

8. An electric arc furnace comprising a furnace vessel (2), means defining a space (8) for accommodating charging material provided on one side of said furnace vessel and connected to the interior (11) of said furnace vessel, a cover (3) for closing said furnace vessel, electrode-passing means (38/1) located in said cover, at least one arc electrode (4/1, 4/2, 4/3) having one end thereof able to protrude via said electrode-passing means into the interior (11) of said furnace vessel, an electrode carrier arm (25/1, 25/2, 25/3; 51/1, 51/2, 51/3) having holding means, the other end of said arc electrode being clamped into said holding means, said space (8) being disposed at least partially in the area of radiation of the arc of said at least one arc electrode, and an electrode lift mechanism (26/1, 26/2, 26/3), said electrode carrier arm being connected to said electrode lift mechanism, characterized in that said electrode carrier arms is connected to said electrode lift mechanisms by way of a horizontal guide means (27/1, 27/2, 27/3; 52/1, 52/2, 52/3) and is reciprocable along the guide means by a drive means which is operative in two directions, whereby the arc electrode and the furnace vessel are displaceable relative to each other in such a way that the arc electrode can be put into a central position in the furnace vessel or a position adjacent the charging material accommodating space (8), and said electrode-passing means comprises slot-like means (38/1) for said arc electrode to pass therethrough, said slot-like means permitting a horizontal path of movement (28/1, 28/2, 28/3) between the arc electrode and the cover (3).

9. A furnace according to claim 8 characterised in that the slot-like electrode-passing means (38/1) is covered by cover plates (35/1), 36/1, 37/1; 35/2; 35/3) which are displaceable along the relative horizontal path of movement (28/1, 28/2, 28/3) and of which one (36/1, 36/2, 36/3) has a through opening (39/1) adapted to the electrode cross-section, and which in any position of the electrode (4/1, 4/2, 4/3) along the relative path of movement (28/1, 28/2, 28/3) close the slot-like electrode-passing means (38/1) in the cover (3).

10. A furnace according to claim 8, characterized in that there are provided three arc electrodes (4/1, 4/2, 4/3), and said guide means (27/1, 27/2, 27/3; 52/1, 52/2/ 52/3) are constructed such that said arc electrodes can be put into an arrangement which is triangular in plan view in the centre of the furnace vessel (2) or an arrangment which is linear or arcuate in plan view, adjacent to the charging material accomodating space (8).

11. A furnace according to claim 10, characterized in that the outer electrode carrier arms (25/1, 25/3; 51/1, 51/3) are pivotable through a restricted angle in a horizontal plane.

12. A furnace according to claim 8, characterized in that the electrode carrier arm (51/1, 51/2, 51/3) is telescopically extensible.

13. A furnace according to claim 8, characterized in that a floor (9) of the charging material accommodating space (8) is disposed at such a depth that, when a liquid sump pool (18) is formed in the furnace hearth, said liquid sump pool extends into said charging material accommodating space, and permits direct material exchange and conductive heat exchange, in the lowermost zone of a column (17) of charging material.

14. A furnace according to claim 8, characterized in that a floor (9) of the charging material accommodating space (8) has a fall towards the furnace hearth (5).

15. A furnace according to any one of claims 1, 2, 3, 4, 5, 6, 8, 9, 10, 11 or 12 characterised in that the interior of a shaft-like charging material preheater (7) which is disposed on one side of the furnace vessel (2) is provided as the space (8) for accommodating the charging material (16), that the interior of said charging material preheater (7) communicates in a region adjoining its floor (9) with the interior (11) of the furnace vessel (2) through a connecting zone (10) through which charging material can be fed to the furnace hearth (5) from the lower section of a column (17) of charging material which is present in the charging material preheater (7) and hot furnace gases can be passed into the charging material preheater (7), and that the charging material preheater (7), in its upper region, has a charging means (12) for the charging material and a gas outlet (13) with a suction removal means for the furnace gas which is cooled down by being in heat exchange relationship with the charging material.

16. A furnace according to claim 15 characterised in that at least one burner (15) or nozzle is disposed in the region of the connecting zone (10).

17. A furnace according to claim 15 characterised in that the connecting zone (10) is of an enlarging configuration inclinedly upwardly from the interior (11) of the furnace vessel (2) to the interior (8) of the charging material preheater (7) and disposed in the enlarged region is a partitioning wall which is provided with gas through-flow openings therein, for maintaining a column (17) of charging material.

* * * * *